US005276936A

United States Patent [19]

Corrigan

[11] Patent Number: 5,276,936

[45] Date of Patent: Jan. 11, 1994

[54] APPARATUS FOR CLEANING EDGE-PERFORATED COMPUTER PAPER

[76] Inventor: Joseph M. Corrigan, 307 Rupel Rd., Union, Ohio 45322

[21] Appl. No.: 729,187

[22] Filed: Jul. 12, 1991

[51] Int. Cl.[5] ..... A46B 11/00; A46B 15/00

[52] U.S. Cl. ..... 15/256.5; 15/104.8; 15/160

[58] Field of Search ..... 15/40, 160, 100, 256.5, 15/256.6, 308, 309.1, 77, 104.8; 400/679, 719

[56] References Cited

U.S. PATENT DOCUMENTS

| | | | |
|---|---|---|---|
| 418,804 | 1/1890 | Miller | 15/308 |
| 1,219,051 | 3/1917 | Tallaksen | 15/256.6 |
| 1,860,306 | 5/1932 | Biener | 15/256.6 |
| 3,189,929 | 6/1965 | Koppehele | 15/100 |
| 3,434,273 | 3/1969 | Lovell | 15/256.6 |
| 3,546,733 | 12/1970 | Johnson | 15/308 |
| 4,861,178 | 8/1989 | Reed | 400/719 |

FOREIGN PATENT DOCUMENTS

| | | | |
|---|---|---|---|
| 631092 | 4/1963 | Belgium | 15/308 |
| 1522765 | 4/1970 | Fed. Rep. of Germany | 15/100 |
| 0152855 | 7/1987 | Japan | 400/719 |
| 153061 | 10/1920 | United Kingdom | 15/308 |

*Primary Examiner*—Edward L. Roberts

[57] ABSTRACT

Paper chaff consisting of confetti, paper dust fibers or crimp lugs are scrubbed from continuous, edge-perforated computer paper between the paper supply and a printer by stationary brushes and are then captured in a collector chamber for subsequent removal. The collector chamber may be removed, emptied and reinstalled without severing the continuous paper web between the printer and the supply or retracting the paper from the printer. When in operative cleaning position, the chamber essentially confines the area where scrubbing takes place except for inlet and outlet slots through which the paper passes, in order to minimize dust particles from becoming airborne and migrating outside the confined area. In its preferred form, the collector chamber includes materials which electrostatically attract and collect such airborne particles. In one form of the invention wherein fan-folded paper is fed from a carton or box directly to a printer, the collector chamber may rest by gravity on or be fastened to the upper edges of the box.

7 Claims, 2 Drawing Sheets

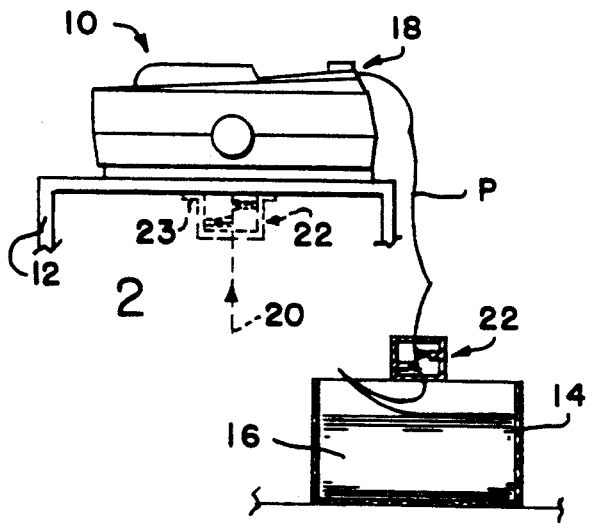
FIG. 1
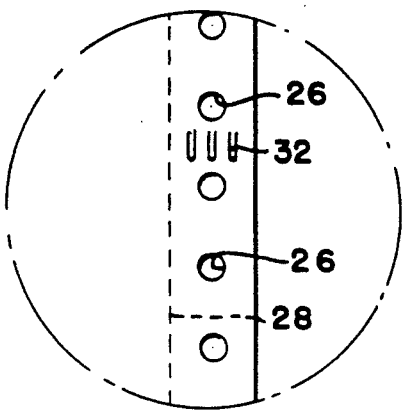
FIG. 3
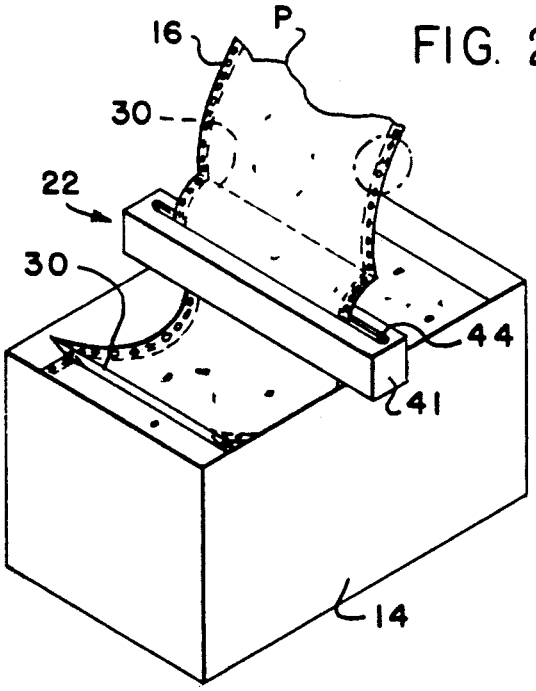
FIG. 2
FIG. 4
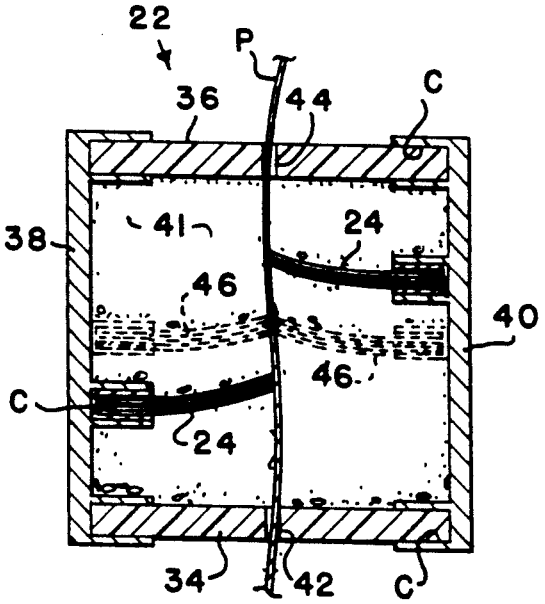

APPARATUS FOR CLEANING EDGE-PERFORATED COMPUTER PAPER

This invention relates generally to cleaning of webs of continuous material travel-ling from a supply of the material to a processing machine in order to keep contaminants carried by the web from reaching the machine. In particular, it relates to cleaning chaff in the form of confetti, paper dust and crimp lugs from computer paper to prevent such chaff from reaching and adversely affecting a computer-controlled printer.

BACKGROUND OF THE INVENTION

The general objective of avoiding or minimizing the affect of contaminants on webs from reaching equipment to which the web is being fed is known in a variety of different arts. For example, U.S. Pat. No. 1,418,830 shows the use of flannel wipers for cleaning film being delivered to a motion picture projector.

More pertinent because of the nature of the cleaning device itself is the teaching in U.S. Pat. No. 3,077,625 by Lindau, who uses brushes on opposite sides of strip material such as movie film or magnetic tape. Lindau recognizes that other types of cleaning elements may also be employed, specifically mentioning "fabric, fibers, magnetic and electrostatic elements". In his claims, Lindau addresses the intent "to at least partially dissipate static charges on the moving film".

DiVito U.S. Pat. No. 3,239,868 shows a pair of brushes contacting film from opposite sides, rather than being staggered along the film as in Lindau.

Other types of machines are also provided with various devices for cleaning continuous web material. Examples of such are Lovell U.S. Pat. No. 3,434,273 for scrubbing driving tapes to keep contaminant build-up from affecting the driving speed of endless tapes of a textile strand processing machine, rotary brushes for scrubbing film as shown in U.S. Pat. Nos. 3,470,576 and 3,945,077 and wiping film and then cleaning the wiper web with vacuum rolls.

It is well appreciated that chaff accumulating on continuous computer paper, i.e., edge-perforated, tractor-driven, fan-folded paper is the cause requiring frequent servicing of printers, resulting also in poor print quality and down-time occasioned by the need to manually clean the printer. Such chaff results from paper dust and confetti remaining on the paper supply after the tractor holes and tear perforations are produced in the web. In the case of multi-part forms, the edges are crimped during production. The crimping is staggered along the perforated edges to hold the forms together, and, depending on the type of crimp made, can also result in some crimp lugs breaking loose and becoming additional chaff. Although the problem has been affecting the computer printing industry for a considerable period, and although web cleaning is commonly addressed in other types of web-fed equipment, nothing appears to have been provided to address the problem in this growing product area.

SUMMARY OF THE INVENTION

A simple, inexpensive cleaner is provided to clean chaff from a web of continuous computer paper by means of brushes which scrub opposite sides of the paper while en route from a paper supply to a printer. The chaff is captured and retained in a collector chamber until it becomes necessary to remove the chamber and take it to a location where the collected chaff can be disposed of prior to reinstalling the chamber in its operative, cleaning position. In the preferred form of the invention, the chamber has no moving parts, can be of very simple and inexpensive construction and can be mounted in a variety of ways and positions to perform its task, depending upon the particular printer installation and type of printer.

A principal object of this invention is to provide a scrubber for continuous computer paper and to locate the scrubber within the confines of a collector chamber which captures and retains collected chaff until disposal.

Another object is to construct such a collector chamber of material which electrostatically attracts chaff for retention within the chamber.

A further object is to enable such a collector chamber to be removed and installed around a web without severing the web or requiring that the web be retracted from the printer during such removal or installation.

An object of one form of the invention is to provide a free-standing collector chamber and to enable the supporting of the collector chamber directly on the box or carton in which fan-folded paper is supplied by the paper vendor.

Other objects and advantages will become apparent from the following description in which reference is made to the accompanying drawings.

BRIEF DESCRIPTION OF THE DRAWINGS

FIG. 1 is a simplified elevational view of a table-mounted printer receiving paper from its shipping container or box, with the collector chamber of the invention being mounted directly on the upper side edges of the box.

FIG. 2 is an isometric view taken looking generally in the direction of the arrow 2 of FIG. 1.

FIG. 3 is an enlargement of the dot-dash circled portion of FIG. 2.

FIG. 4 is a vertical cross-sectional view of one form of collector chamber of the invention.

DETAILED DESCRIPTION OF THE INVENTION

Figure 5:
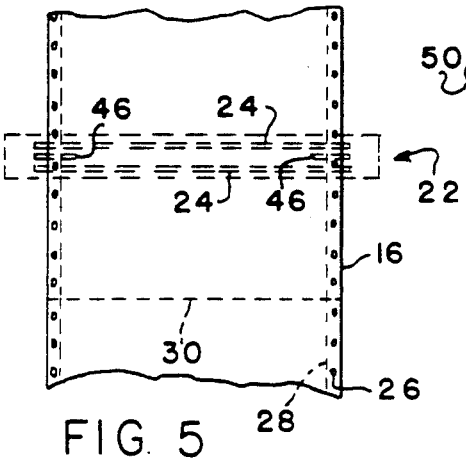
FIG. 5 is a representation of a form of the invention in which the perforated edges are subjected to a vigorous scrubbing action for maximum cleaning effectiveness.

In FIG. 1, a printer 10 is supported on a table 12 at a level above a box 14 of fan-folded computer paper 16. The paper, while commonly referred to in the trade as being continuous, has a finite lead end at the top of the box and a finite trailing end at the bottom. The box 14 can rest on the floor or on an intermediate shelf of the table. The lead end, when a new supply of paper is to be fed to the printer, is threaded into the printer at the back thereof as shown at 18, or can be fed from below as shown by dotted line 20 for that type of printer accommodating a bottom in-feed. A collector chamber 22 is shown in full lines resting on the upper edges of the box 14 in the case of a back infeed to the printer, and in dotted lines in the case of a bottom feed. When fed through the bottom, the chamber 22 is supported in brackets 23 connected to the underside of table 12. The collector chamber 22 is shown in detail, although somewhat simplified, in FIG. 4. The purpose of the chamber is to have scrubbing means therein in the form of brushes 24 contact opposite sides of the paper while it is being fed to the printer 10, and to retain and collect contaminating particles scrubbed from the paper.

The type of contaminants involved depends on the type of paper being printed. Fan-fold paper typically has a perforated edge with two types of perforations. Since such paper stock is tractor fed at the side edges by standard tractor means (not shown) in the printer housing, holes 26 are punched in the edges to correspond to the driving sprockets (also not shown) of the tractor. The paper holes are illustrated in FIG. 3. In addition, a tear-type perforation 28 is created during production of the paper so that the edge of the paper containing the holes 26 can be removed and disposed of upon completion of printing. Also, a cross perforation 30 (FIG. 2) is provided for enabling the continuous paper stock to be torn into discrete sheets. All of this is well familiar to persons in the computer and computer printer industry. Also familiar to such persons is the large amount of paper dust commonly found in printers to which such paper is fed, particularly in large volume operations where paper cost is a major consideration. The lower the paper cost, the poorer the paper quality and the higher the amount of chaff. Somewhat less common, but present nevertheless, is confetti carried to the printer from the paper supply. This confetti is the residue or chaff from the paper punching which produces the holes 26. For purposes of this application, the term chaff is employed generically to encompass the confetti, paper dust or fibers created in making the perforations 28 and 30, and crimp lugs 32 shown best in FIG. 3. The lugs 32 are used to hold multi-part computer paper together in known fashion.

Depending on the quality of the paper used, more or less chaff will pass with the paper into the printer unless some way is provided to remove the chaff. Clearly, it is not feasible to clean the paper unless it is done while the paper is being fed to the printer. Nor is it practical to attempt to do what has been done in other arts, merely wipe or brush the chaff from the paper and hope that it will not return to the paper stock. It is altogether too obvious to elaborate on the need to prevent or at least minimize the amount of chaff reaching the printer. Let it suffice to say only that any contamination of the printer requires more down-time due to added cleaning, reduced print quality where the dust fibers collect on the print head and greater likelihood of wear and tear on the more delicate moving parts of the printer.

In order to eliminate or reduce the problems noted, I have discovered that provision of a collector chamber functions to retain the chaff for a period of time in the collection area until a time when it is convenient to remove the collector chamber 22, blow out the collected chaff and restore the chamber to its operative, cleaning position. Quite surprisingly, I have found in my design that the chaff clings tightly to the inner surfaces of the chamber 22. This is most likely due to the brushing action creating a static charge on the particles, particularly the dust, and the use of plastic plates 34 and 36 (.FIG. 4) as part of the enclosure of the chamber 22. Dust adheres on the plates and ordinarily requires wiping as well as a blowing out when cleaning is performed.

In FIG. 4, I illustrate in vertical cross section my prototype collector chamber 22. It was constructed of two metallic sides 38 and 40 which were machined to provide channels C to receive the edges of plates 34 and 36. End caps 41 (FIG. 2) enclose the remainder of the chamber to confine the chaff collecting area, Additional channels C were also provided to receive metallic supports for a pair of the elongated brushes 24, one on each side of the paper P. Plates 34 and 36 are slotted at 42 and 44 respectively to enable the paper P to pass vertically upward toward the printer 22. The slots are of a width to allow a small clearance for maximum width multipart forms to be fed to the printer. Sides 38 and 40 can be made from a single aluminum extrusion, with the opposing sides being inverted. The brushes were arranged with cleaning edges slightly overlapping an imaginary plane between the centers of slots 42 and 44 to scrub the paper with a small amount of force, and this causes the paper passing through the chamber to assume a slight S-curve or serpentine path as seen in FIG. 4. Whether this action effects any of the creation of the static charge is unknown, but it has been observed that the paper rubs against the right side of slot 42, which serves as an inlet slot, and against the left side of slot 44, which forms an outlet slot. The design and construction of the chamber and its contents can be varied to meet the needs of a particular type of paper and printer. Further, while an electrostatic attraction appears to provide excellent results, it is believed that the invention will perform satisfactorily even if materials are employed that do not create any kind of static charge.

It has been noted in comparative experiments (without the collector chamber 22 attached) that excessive dust collects on the printer roller platen in line with the two side edges of the paper. Those edges are generally aligned with the perforations 28. Because the largest amount of chaff, particularly dust, is found along these edge-perforations, I provide a more vigorous scrubbing action along the edges than what I provide across the remainder of the width of the paper. This is accomplished by providing opposing pairs of short brushes 46 shown in FIGS. 4 and 5. When both brushes 24 and 46 are used, brushes 24 become the primary ones, and 46 the secondary brushes. This is preferable to using more of the brushes 24, since full length brushes can create excessive paper drag and make paper feed more difficult.

Figure 6:
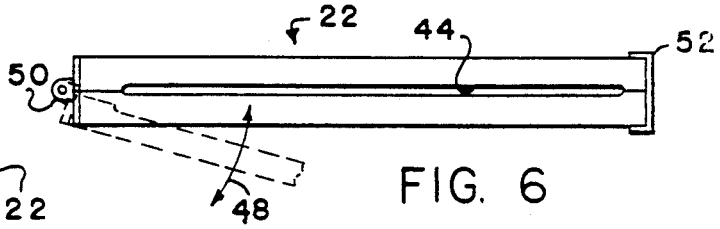
FIG. 6 is a simplified plan view of the collector chamber illustrating its capability for simple installation and removal of the unit.

FIG. 6 illustrates a plan view of the chamber 22, which I prefer to make as two separate hinged halves to allow easy installation and removal of the chamber relative to the web of paper P. Arrow 48 shows one side moving about hinge 50 after a clamp or latch 52 has been unlatched. This enables me to remove the chamber at any time during a run of paper, although it would normally be cleaned only when the supply in the box 14 has been depleted. Such removal capability avoids the necessity of breaking the web or withdrawing the lead end of the supply from the printer.

Figure 7:
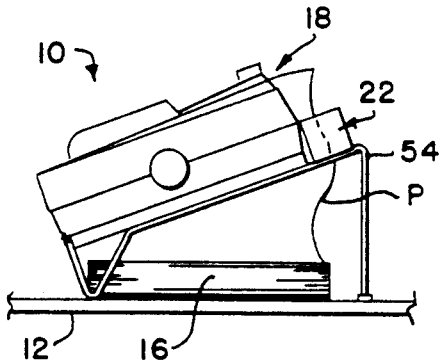
FIG. 7 is an elevational view similar to FIG. 1, but showing another means for mounting the chamber.

FIG. 7 shows a printer and chamber installation in which the paper P is located directly beneath a printer mounted on a stand 54 and fed into the back of the printer. Collector chamber 22 rests on the stand 54 at the rear of the pi-inter 10. The paper passes vertically through the chamber 22, making chaff collection easier at the sides of the paper.

In the installations of FIGS. 1 and 7, the chamber 22 rests by gravity on either the box 14 or the stand 54. However, the chamber may be mounted on an auxiliary device such as that shown in FIG. 8 or any of a large variety of other mounting means. The design of FIG. 8 enables the chamber 22 to be made of two separately mountable halves 56, supported on opposed stanchions 58. This approach allows the collector chamber 22 to be raised above the top level of the box 14, making feed from the topmost sheets of the supply easier. The halves 56 may be molded of plastic with the brushes carried thereby either molded directly into the halves or detachable therefrom. In the illustration, each half is provided with a pair of pins 60 on each end, fitting into notches 62. Detents 64 assist in latching each half 56 to the stanchions when the collector is in cleaning position.

Figure 8:
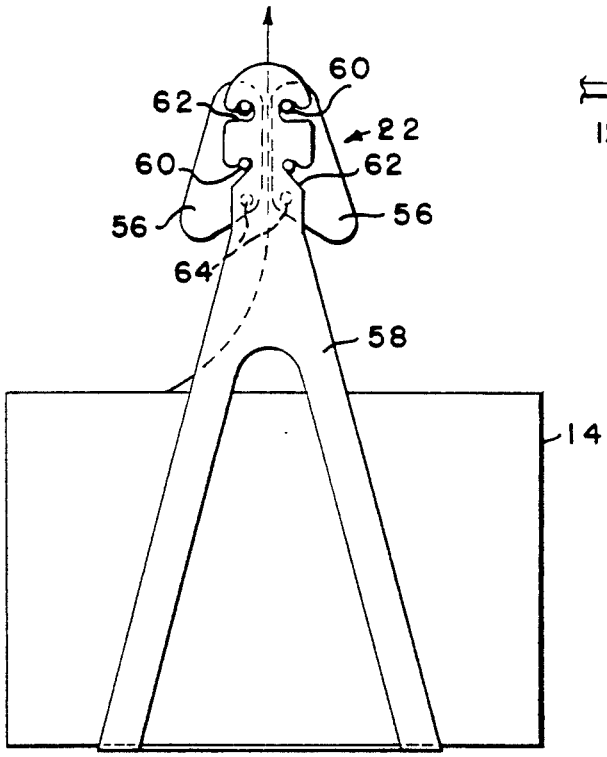
FIG. 8 is a side elevational view of another type of collector chamber consisting of two halves mounted on stanchions so as to be located slightly above the top edge of the supply box.

Clearly, when using a structure of the nature of that illustrated in FIG. 8, the inlet and outlet slots in the collector chamber are formed by the spacing between the separate halves. If desired, one half may be laterally adjusted relative to the other in accordance with the thickness of the paper or forms being printed.

Various changes may be made without departing from the spirit and scope of the claims.

Having described my invention, I claim:

1. Cleaning apparatus for removing and collecting chaff in the form of confetti, paper dust or crimp lugs from edge-perforated continuous computer paper movable intermittently along a predetermined path from a supply of such paper to a computer-controlled printer, said cleaning apparatus consisting of:

an essentially enclosed collector chamber comprising plate portions made of a material which electrostatically attracts and retains charged chaff, said chamber surrounding a portion of said path and having a paper inlet slot and a paper outlet slot in said plate portions, paper scrubbing brush means mounted in said chamber on opposite sides of said path with cleaning edges positioned to physically contact the opposite sides of the paper as the paper moves between the inlet and outlet slots, said cleaning edges overlapping an imaginary plane between said inlet slot and said outlet slot and being spaced linearly along said paper path to create a serpentine paper section within said collector chamber as a result of brush contact with the paper, and means for mounting said collector chamber in a predetermined location between said supply and said printer.

2. The cleaning apparatus of claim 1 wherein the computer paper to be cleaned is fan-folded, cross-perforated paper contained in flat-sheet condition in an open-topped box having a bottom and side walls, and wherein said chamber is elongated laterally of the paper and is of a length whereby its ends extend beyond the side walls of the box, said chamber mounting means consisting of means supporting the extended ends of said collector chamber adjacent the upper edges of the box.

3. The cleaning apparatus of claim 2 wherein the weight of the chamber is sufficiently heavy to cause it to rest freely on the side wall upper edges by gravity, such weight resisting any frictional forces created by the scrubbing means.

4. The cleaning apparatus of claim 3 wherein, when the chamber is supported on said side wall upper edges, the chamber inlet faces downwardly toward said supply.

5. The cleaning apparatus of claim 2 wherein said chamber mounting means comprises auxiliary means supported adjacent the side walls of said box.

6. The cleaning apparatus of claim 1 wherein the brush means on each side of said path comprises a primary brush extending crosswise for the full width of said paper, and at least one shorter secondary brush at each side edge extending along and spanning said edge perforations.

7. The cleaning apparatus of claim 6 wherein the secondary brushes on one side of the paper are directly opposite the secondary brushes on the other side.

* * * * *